US006997250B2

(12) United States Patent
Dilley et al.

(10) Patent No.: US 6,997,250 B2
(45) Date of Patent: Feb. 14, 2006

(54) HEAT EXCHANGER WITH FLOW DIRECTOR

(75) Inventors: Roland Dilley, Lomita, CA (US); Richard Paul Beldam, Torrance, CA (US); Keith Agee, Torrance, CA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/632,590

(22) Filed: Aug. 1, 2003

(65) Prior Publication Data

US 2005/0022982 A1 Feb. 3, 2005

(51) Int. Cl.
*F28F 9/02* (2006.01)

(52) U.S. Cl. ..... 165/174; 165/99; 165/165; 165/159

(58) Field of Classification Search ..... 165/166, 165/167, 146, 170, 159, 174, 176
See application file for complete search history.

(56) References Cited

U.S. PATENT DOCUMENTS

| | | | | | |
|---|---|---|---|---|---|
| 709,051 | A | * | 9/1902 | Schneller | 165/174 |
| 740,655 | A | * | 10/1903 | Guinan | 165/174 |
| 828,807 | A | * | 8/1906 | Bolton | 122/470 |
| 1,971,842 | A | | 1/1934 | Young | |
| 2,589,730 | A | * | 3/1952 | Rathkey | 165/146 |
| 2,602,647 | A | * | 7/1952 | Miller | 165/109.1 |
| 2,729,432 | A | * | 1/1956 | Berg | 165/103 |
| 2,768,814 | A | * | 10/1956 | Frey et al. | 165/139 |
| 2,990,163 | A | | 6/1961 | Farrell | |
| 3,217,793 | A | | 11/1965 | Coe | |
| 3,759,319 | A | * | 9/1973 | Ritland et al. | 165/111 |
| 3,983,932 | A | | 10/1976 | Yamaguchi et al. | |
| 4,047,562 | A | * | 9/1977 | Weber | 165/111 |
| 4,293,033 | A | * | 10/1981 | Nasser | 165/166 |
| 4,522,252 | A | * | 6/1985 | Klaren | 165/104.16 |
| 4,574,007 | A | | 3/1986 | Yearout et al. | |
| 4,728,468 | A | | 3/1988 | Duke | |
| 4,736,713 | A | * | 4/1988 | Roarty | 122/32 |
| 4,905,895 | A | | 3/1990 | Grebe et al. | |
| 5,000,259 | A | * | 3/1991 | Forrest | 165/176 |
| 5,062,475 | A | | 11/1991 | Bemisderfer et al. | |
| 5,107,923 | A | * | 4/1992 | Sherman et al. | 165/159 |

(Continued)

FOREIGN PATENT DOCUMENTS

JP 410331724 A 12/1998

(Continued)

*Primary Examiner*—Terrell Mckinnon
(74) *Attorney, Agent, or Firm*—Chris James

(57) ABSTRACT

Heat exchangers, constructed in accordance with principles of this invention, comprise a plurality of first passages, for transporting a first fluid or gas therethrough, and one or more second passages for transporting a second fluid or gas therethrough. The second passages are positioned adjacent to the first passages to permit a desired transfer of thermal energy from the first passages to the second passages. At least one manifold is placed in communication with one of the first or second passages. The manifold includes an opening disposed therethrough for receiving or dispensing the first or second fluid or gas to or from the first or second passages. The heat exchanger includes a flow director disposed therein for diverting or distributing the flow of first or second fluid or gas in a manner different from a natural fluid or gas flow within the heat exchanger. The flow director can be provided as an integral part of the heat exchanger itself, or can be provided as a separate element within the heat exchanger.

18 Claims, 4 Drawing Sheets

U.S. PATENT DOCUMENTS

| | | | | | |
|---|---|---|---|---|---|
| 5,150,278 | A | | 9/1992 | Lynes et al. | |
| 5,186,249 | A | * | 2/1993 | Bhatti et al. | 165/174 |
| 5,209,289 | A | | 5/1993 | Haushalter | |
| 5,211,222 | A | | 5/1993 | Shinmura | |
| 5,261,485 | A | * | 11/1993 | Thornton et al. | 165/174 |
| 5,400,854 | A | * | 3/1995 | Iio et al. | 165/157 |
| 5,419,391 | A | * | 5/1995 | Chan et al. | 165/159 |
| 5,465,783 | A | * | 11/1995 | O'Connor | 165/134.1 |
| 5,505,257 | A | | 4/1996 | Goetz | |
| 5,653,282 | A | * | 8/1997 | Hackemesser et al. | 165/134.1 |
| 5,669,438 | A | | 9/1997 | Beales et al. | |
| 5,927,392 | A | | 7/1999 | Youn et al. | |
| 6,065,530 | A | | 5/2000 | Austin et al. | |
| 6,125,926 | A | | 10/2000 | Okamoto et al. | |
| 6,247,523 | B1 | | 6/2001 | Shibagaki et al. | |
| 6,340,052 | B1 | * | 1/2002 | Uehara | 165/166 |
| 6,382,313 | B1 | * | 5/2002 | Mitsumoto et al. | 165/159 |
| 6,435,268 | B1 | | 8/2002 | Bhatti et al. | |
| 2002/0074105 | A1 | | 6/2002 | Hayashi et al. | |
| 2003/0111209 | A1 | * | 6/2003 | Tsujita et al. | 165/51 |

FOREIGN PATENT DOCUMENTS

| | | | |
|---|---|---|---|
| JP | 411303689 | A | 11/1999 |

* cited by examiner

HEAT EXCHANGER WITH FLOW DIRECTOR

FIELD OF INVENTION

This invention relates generally to the field of heat exchangers and, more particularly, to heat exchangers that are specifically configured to have one or more internal members for directing the flow of fluid in a desired manner to optimize heat exchanger operation.

BACKGROUND OF THE INVENTION

The present invention relates to heat exchangers that are generally configured comprising one or more manifold members that are constructed to receive and/or dispense a particular fluid or gas in need of cooling, and a core member that is connected to the manifold members. The core member is constructed to accommodate passage of a particular fluid or gas therethrough to achieve cooling of the same via conductive and/or convective heat transfer. The heat exchanger can also include one or more manifold members constructed to receive and/or dispense a particular cooling fluid or gas, and place the same into contact with the core member. Such heat exchangers known in the art can be configured having a single or multiple pass hot-side or cold-side designs The core member is typically configured to provide a desired degree of conductive and/or convective heat transfer. In a typical example, the core comprises a plurality of hollow heat transfer passages sized to permit a desired degree of fluid or gas flow therethrough. These heat transfer passages are also configured comprising fins that are specially designed to promote conductive and/or convective cooling.

A problem known to exist in conventional heat exchangers involves the existence of undesired flow disparities and maldistribution of fluid or gas through the exchanger. This can occur with fluid or gas flow on the hot side and/or cold side of the exchanger. Such flow disparities and maldistributions are generally undesired, as they tend to have an adverse impact on achieving an optimum cooling efficiency. For example, the fluid or gas distributed through the heat exchanger may not be able to achieve a desired level of cooling at a desired flow rate. It may, therefore, be necessary to reduce the throughput rate of the fluid or gas, and/or increase the sizing of the heat exchanger to meet the desired cooling performance.

Additionally, the presence of flow disparities or maldistribution of fluid or gas flow within a heat exchanger can also lead to the localized concentration or absence of thermal energy, e.g., creating one or more unwanted cold or hot spots. Such localized heating or cooling is known to generate high local stresses within the heat exchanger. After repeated heating and cooling cycles, such localized stresses can lead to the premature failure of the heat exchanger, thereby limiting its useful service life.

It is, therefore, desired that a heat exchanger be constructed in a manner that provides an improved degree of fluid or gas flow distribution therein to minimize and/or eliminate the above-noted problems associated with flow disparities or flow maldistribution within the heat exchanger. It is desired that such heat exchangers be configured in a manner that does not adversely impact spatial concerns regarding mounting the same for use, thereby permitting easy retrofit use to replace conventional heat exchangers. It is further desired that such heat exchangers be constructed using materials and methods that are readily available to facilitate cost effective manufacturing and assembly of the same.

SUMMARY OF THE INVENTION

Heat exchangers, constructed in accordance with principles of this invention, can be of the shell-and-tube or bar-and-plate design, and typically comprise a construction including a plurality of first passages, for transporting a first fluid or gas therethrough, and one or more second passages for transporting a second fluid or gas therethrough. The first and second passages can be configured in the form of tubes disposed within a shell, or as a core comprising both sets of passages. In either construction, the second passages are positioned adjacent to the first passages to permit a desired transfer of thermal energy from the first passages to the second passages.

The heat exchanger includes a manifold in communication with one of the first or second passages. The manifold includes an opening disposed therethrough for receiving or dispensing the first or second fluid or gas to or from the first or second passages. In an example embodiment, the heat exchanger can include one or more of a hot-side inlet manifold and a hot-side outlet manifold in fluid flow communication with the plurality of first passages, and one or more of a cold-side inlet manifold and a cold-side outlet manifold, in fluid flow communication with the second passages.

The heat exchanger also includes means disposed therein for directing the flow of the first or second fluid or gas in a direction different from a natural flow direction within the heat exchanger. The means for directing can be provided as an integral part of the heat exchanger itself, such as the shape of the first or second flow passages, or the shape of one or more of the manifolds. Alternatively, the means for directing can be provided in the form of a separate element disposed within one or more of the manifolds that is configured to have a desired flow directing and/or distributing impact on the fluid or gas passing thereby.

Additionally, a heat exchanger of the present invention may comprise a plurality of first passages for transporting a first fluid or gas therethrough; one or more second passages for transporting a second fluid or gas therethrough, the second passages being positioned adjacent to the first passages to permit the transfer of thermal energy from the first passages to the second passages; a manifold in communication with one of the first or second passages, the manifold including an opening disposed therethrough for receiving or dispensing the first or second fluid or gas from the first or second passages; and means disposed within the heat exchanger for directing the flow of the first or second fluid or gas in a direction different from a natural flow direction within the heat exchanger.

Additionally, a heat exchanger of the present invention may comprise a core member including: a plurality of hot-side fluid or gas transport passages for accommodating passage of a first fluid or gas therein; a plurality of cold-side fluid or gas transport passages for accommodating passage of a second fluid or gas therein that is provided at a temperature less than that of the first fluid or gas, the hot-side and cold-side fluid or gas transport passages being in contact with one another to permit conductive heat transfer; manifolds connected to ends of the hot-side and cold-side fluid or gas passages to direct and receive the first and second fluids or gases into and from the respective hot-side and cold-side fluid or gas transport passages; wherein one of the hot-side or cold-side fluid or gas transport passages are positioned within the core having a fluid or gas flow path different than that of fluid or gas flowing through a manifold connected with one of the hot-side or cold-side fluid or gas transport passage.

Heat exchangers comprising such flow directing means demonstrate an improved degree of fluid or gas flow distribution within the heat exchanger, when compared to conventional heat exchangers, thereby operating to minimize and/or eliminate known problems associated with flow disparities or flow maldistribution within the heat exchanger.

BRIEF DESCRIPTION OF THE DRAWINGS

The invention will be more clearly understood with reference to the following drawings wherein.

DETAILED DESCRIPTION OF THE INVENTION

The present invention relates to heat exchangers used for reducing the temperature of an entering gas or fluid stream. The particular application for the heat exchangers of the present invention is with vehicles and, more particularly, to cool an exhaust gas stream in an exhaust gas recirculation (EGR) system, or to cool a pressurized air intake stream in a turbocharged or supercharged engine system. However, it will be understood that these are only exemplary embodiments. It will be readily understood by those skilled in the relevant technical field that the heat exchanger configurations of the present invention described herein can be used in a variety of different applications.

Generally, the invention constructed in accordance with the principles of this invention, comprises a heat exchanger that includes at least one flow director disposed therein for changing a character of the flow of fluid or gas within at least one heat exchanger passage. The invention can be used with shell-and-tube and bar-and-plate type heat exchangers. In either application, the flow director is in the form of a member that is configured to intentionally change the flow character of a gas or fluid entering or exiting the heat exchanger. In an example embodiment, the flow director may be in the form of a fin, a baffle, a block, a perforated plate, a series of strips or the like.

Figure 1:
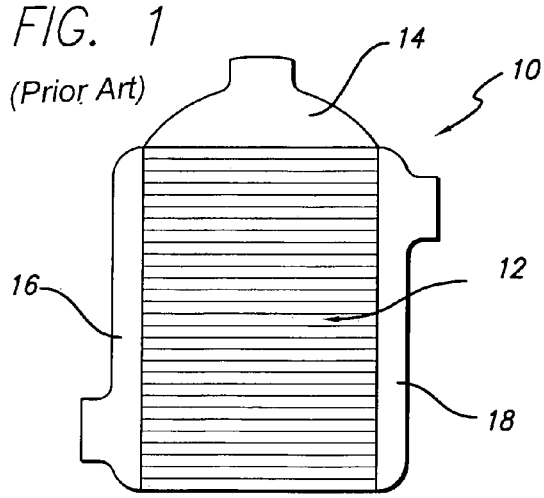
FIG. 1 (Prior Art)
FIG. 1 is a cross-sectional view of a prior art heat exchanger comprising conventional horizontally-oriented cooling fins.

FIG. 1 illustrates a prior art heat exchanger 10 comprising a core member 12 disposed within the heat exchanger that is configured having a plurality of heat transport passages therethrough (not shown). A hot-side inlet manifold 14 is attached to a top end of the core 12 and is configured to receive an inlet stream of hot fluid or gas for directing to the core heat transport passages. The exchanger also includes a cooling-side inlet manifold 16 and a cooling-side outlet manifold 18 that are each attached at opposite sides of the core 12, and that operate to transport a desirable cooling medium to and from the core.

Configured in this manner, hot fluid or gas entering the exchanger passes through the core in a generally vertical direction, while cooling fluid or gas passes through the exchanger in a generally horizontal direction, i.e., in a direction perpendicular to the hot-side fluid or gas and parallel to the direction of fluid or gas flow through the cooling-side manifolds. In an example prior art embodiment, the exchanger is a bar and plate type exchanger. A problem known to exist with such prior art exchangers is that the manifolds produce uneven flow conditions within the core, which can cause localized concentrations of thermal energy and related unwanted concentrations of thermal stress. Specifically, in this prior art example, the majority of the cooling fluid flow will travel along the most direct path from the coolant inlet to the coolant outlet. This leads to an abundance of cooling at the coolant outlet end of the hot fluid inlet, and a reduced amount of cooling at the coolant inlet end of the hot fluid inlet. These differences in the cooling rates, depending on the hot side flow distribution, can lead to a large temperature gradient from one side of the hot fluid inlet to the other, thus generating large thermal stresses.

In one embodiment, heat exchangers comprising a flow director of this invention are configured having a core with fins specifically configured to provide a desired fluid or gas flow direction on the hot and/or cold fluid or gas side. Because the fins are actually part of the core itself, and because the fins are used to change the direction of fluid or gas flow, they are considered to be integral flow directors in the heat exchanger.

Figure 2:
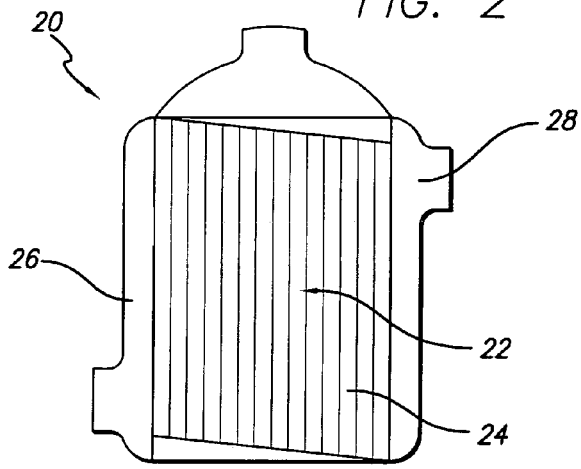
FIG. 2 is a cross-sectional view of a heat exchanger comprising vertically-oriented integral flow directors of this invention.

FIG. 2 illustrates a heat exchanger 20 comprising an example flow director of this invention. The heat exchanger 20 comprises a core 22 that, unlike the prior art example described above and illustrated in FIG. 1, is intentionally configured having a plurality of integral flow directors 24, e.g., fins, that are oriented to direct a cooling fluid or gas vertically within the exchanger from the cooling-side inlet manifold 26 to the cooling-side outlet manifold 28. This direction of fluid or gas flow is perpendicular to the natural flow of the same through the cooling-side inlet and outlet manifolds. Positioning the fins in this manner to produce vertical flow of cooling fluid within the heat exchanger is desired because it directs the fluid so as to impinge directly onto the hot inlet header, thus increasing cooling in the hottest portion of the heat exchanger. This creates a more even temperature distribution and a smaller temperature gradient from one end of the hot fluid inlet to the other, thus reducing the resultant thermal stresses.

Figure 3:
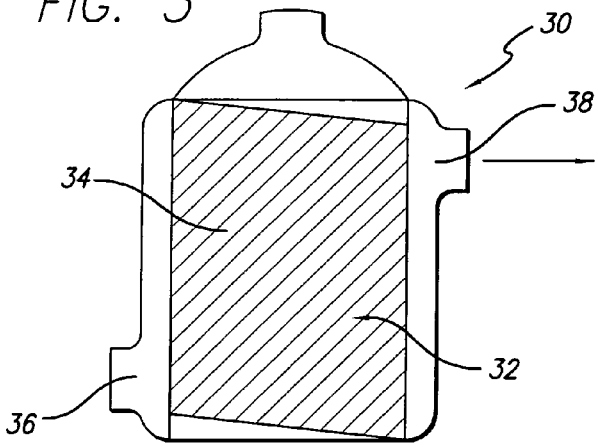
FIG. 3 is a cross-sectional view of a heat exchanger comprising diagonally-oriented integral flow directors of this invention.

FIG. 3 illustrates a heat exchanger 30 comprising another example flow director of this invention. The heat exchanger comprises a core 32 that includes a plurality of integral flow directors 34, e.g., fins, intentionally oriented to direct a cooling fluid or gas diagonally within the exchanger from the cooling-side inlet manifold 36 to the cooling-side outlet manifold 38. This direction of fluid or gas flow is diagonal to the natural flow of the same through the cooling-side inlet and outlet manifolds. Positioning the fins in this manner to produce diagonal flow of cooling fluid within the heat exchanger is desired because it directs the fluid so as to impinge directly onto the hot inlet header, thus increasing cooling in the hottest portion of the heat exchanger. The angle of the fin can be optimized in this configuration in order to provide the best compromise between effective cooling of the hot inlet header and coolant pressure losses. The angle of the fin also serves to direct more cooling fluid to one portion of the hot inlet header than to another, thus compensating for temperature and flow variations on the hot fluid side of the heat exchanger, reducing temperature gradients and minimizing thermal stresses.

By orienting the integral flow directors, e.g., fins, in a direction other than that of the overall fluid flow, the fluid may be redistributed over, or redirected to, areas of concern. In this manner, uneven flow conditions in the manifolds can be prevented, and localized areas of higher heat transfer which minimize temperature gradients and reduce thermal stress concentrations can be created.

During heat exchanger core construction, the fins are oriented in a predetermined direction that is appropriate to provide the desired flow characteristics in service. A skilled artisan can orient the fins as desired for a particular application or a particularly sized heat exchanger. For example, the fins can be turned 90 degrees from their normal orientation (aligned perpendicular with the overall fluid flow direction), as shown in FIG. 2. It will be understood that, the fins can be cut and shaped as necessary for any desired angle or flow distribution.

While the specific embodiments of integral flow directors of this invention have been described and illustrated in FIGS. 2 and 3, it is noted that other embodiments of heat exchangers comprising integral flow directors oriented differently than specifically described and illustrated are considered to be within the scope of this invention. A key feature of such integral flow directors of this invention is that they are specifically oriented to direct fluid or gas flow within the heat exchanger in a direction that is not otherwise in the normal direction of fluid or gas flow therein.

Additionally, while example embodiments of integral flow directors have been described and illustrated comprising a plurality of elements oriented in the same general manner, integral flow directors of this invention can be configured to provide fluid or gas flow in more than one direction. For example, integral flow directors of this invention can be configured having a compound shape comprising one or more curved sections or the like to direct flow within the heat exchanger in a certain desired manner. The exact shape and configuration of the integral flow director is understood to vary depending on a variety of factors such as the type of fluid or gas being directed, the flow rate of the same, the exact geometric configuration of the core, the size of the heat exchanger, and the like.

Figure 4:
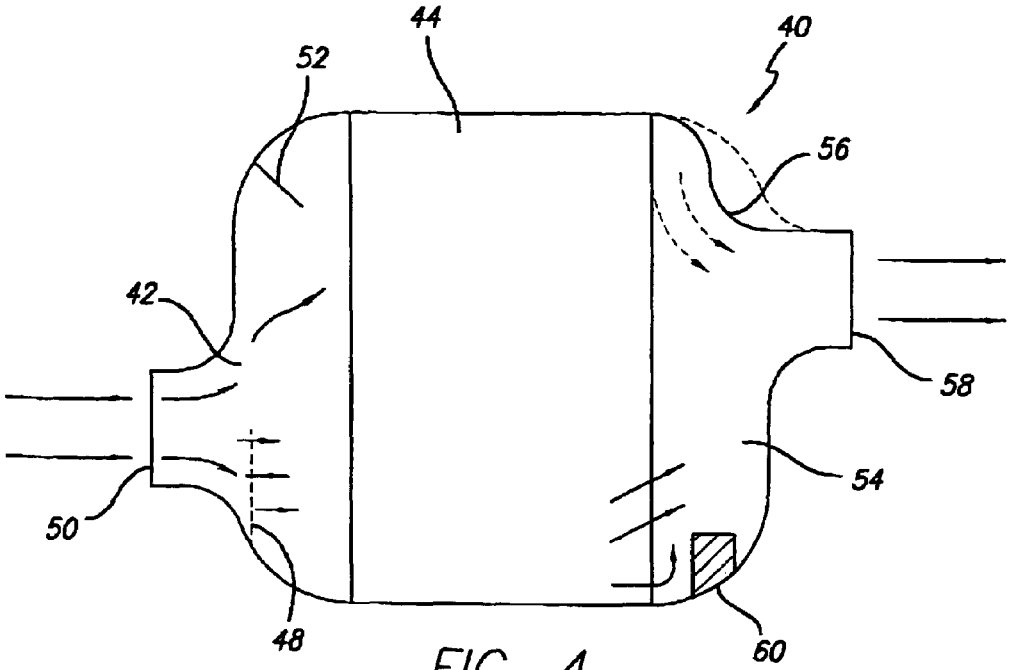
FIG. 4 is a cross-sectional view of a heat exchanger comprising a number of internal flow director embodiments of this invention disposed therein.

FIG. 4 illustrates a heat exchanger 40 comprising a number of differently configured flow directors disposed therein. It is to be understood that this figure is provided only for purposes of referencing different types of integral flow directors, and is not intended to represent a heat exchanger would include each of the different flow directors. Unlike the flow directors discussed above and illustrated in FIGS. 2 and 3, the flow directors shown in FIG. 4 are disposed within one or more of the heat exchanger manifold members and not the core.

Moving from left to right across FIG. 4, the heat exchanger includes an inlet manifold 42 that is configured to receive an inlet stream of fluid or gas for directing the same towards the heat exchanger core 44. For purposes of directing or conditioning the flow of entering fluid or gas in a desired manner, an integral flow director can be positioned within the inlet manifold. The exact placement and configuration of the flow director can and will vary depending on the particular application.

For example, in one embodiment, the integral flow director can be in the form of a perforated member or plate 48 positioned downstream of an inlet opening 50. Configured in this manner, the flow director functions to diffuse or more uniformly distribute the flow of incoming fluid or gas across the director surface area for passage to the core. The perforated member 48 can be configured within the manifold 42 to extend across the entire inlet opening 50, so that all entering fluid or gas must pass therethrough, or can be configured within the manifold to contact only a partial portion of the incoming fluid or liquid.

The exact configuration of the perforated member, e.g., its surface area, number and size of perforations, and location and angle of placement within the manifold, are all understood to vary depending on the particular application. The perforated member can be formed from metal or other suitable structural material having a number of openings disposed therethrough. The perforated member can be formed as part of the manifold itself, e.g., by molding, or can be provided as a separate part that is attached to an inside surface of the inlet manifold by conventional methods, such as by welded attachment or the like.

In another embodiment, the integral flow director can be in the form of a non-perforated baffle or plate 52 positioned downstream of the inlet opening 50. Unlike the perforated member 48 discussed above, the solid plate or baffle is positioned within the inlet manifold to direct fluid or gas around it rather than through it in a predetermined manner to achieve a desired flow redirection goal. If desired, however, the baffle or plate can include one or more openings disposed therethrough to perform dual functions of both diverting and diffusing fluid or gas flow within the heat exchanger. Like the perforated member embodiment, the exact configuration of the solid baffle or plate, e.g., its surface area, and location and angle of placement within the manifold, are all understood to vary depending on the particular application. The solid baffle or plate can be formed from metal or other suitable structural material, can be formed as part of the manifold itself, e.g., by molding, or can be formed as a separate part that is attached to an inside surface of the inlet manifold 50 by conventional methods, such as by welded attachment or the like.

Moving to an opposite side of the core, an outlet manifold 54 is attached thereto that is configured to receive fluid or gas from the core and for directing the same from the heat exchanger. For purposes of diverting the flow of exiting fluid or gas in a desired manner, an integral flow director can be positioned within the outlet manifold. The exact placement and configuration of the flow director can and will vary depending on the particular application.

For example, in one embodiment, the integral flow director can be in the form of a side wall 56 of the outlet manifold itself. In this embodiment, a section of the manifold wall itself is intentionally designed to direct the flow of fluid or gas within the manifold in a predetermined manner. In the example illustrated, a shoulder portion of the outlet manifold can be moved inwardly towards the core 44 to help provide a more direct passage of fluid or gas from the core to an outlet opening 58 in the manifold. It is to be understood that this is but one example of how the manifold structure itself can be tailored to provide a desired fluid or gas flow characteristic within the heat exchanger and that other variations of modifying the heat exchanger structure are intended to be within the scope of this invention. This particular embodiment of the integral flow director can be useful in situations where it is cost effective to reshape the manifold itself, such as when designing a completely new heat exchanger, in comparison to adding another form of integral flow director to an already-designed manifold as discussed above.

In another embodiment, the integral flow director can be in the form of a block member 60 positioned downstream of the core 44 and upstream of the outlet opening 58. The term "block member" is defined to mean that the flow director has a relatively greater thickness than that of a plate, i.e., it is three-dimensional. The block member can be solid or hollow. This embodiment of the flow director is provided for the purpose of occupying a desired volume within the manifold and deflecting the flow of fluid around it in a predetermined manner to achieve a desired fluid or gas flow characteristic within the heat exchanger.

Like the other above-described flow director embodiments, the exact configuration of the block member, e.g., its dimension and surface area, and location and angle of placement within the manifold, are all understood to vary depending on the particular application. The block member can be formed as part of the manifold itself, e.g., by molding, or can be formed as a separate part from metal or other suitable structural material that can be attached to an inside surface of the outlet manifold 54 by conventional methods, such as by welded attachment or the like.

While specific embodiments of flow directors of this invention have been described and illustrated in FIG. 4, it is to be understood that these embodiments are only exemplary of the many different types of integral flow directors that are intended to be within the scope of this invention. Additionally, although the four example flow director embodiments illustrated in FIG. 4 have been described and illustrated as being positioned within an inlet or outlet manifold, it is to be understood that the flow directors of this invention can be used in either heat exchanger manifold member interchangeably to achieve a desired change in the fluid or gas flow characteristic.

Additionally, it is to be understood that the flow director embodiments described above and illustrated in FIG. 4 can be used be used to provide desired flow changes in either the hot or cold side of the heat exchanger. For example, the integral flow director can be placed in one or both of the cooling medium inlet and/or outlet manifolds, or in one or both of the hot fluid or gas inlet and/or outlet manifolds. Also, should the heat exchanger be of a multi-pass design, the integral flow director can be positioned in one or both sides of a common end manifold, i.e., a manifold that is configured having independent chambers for both directing fluid or gas to the core and receiving fluid or gas from the core.

Figure 5B:
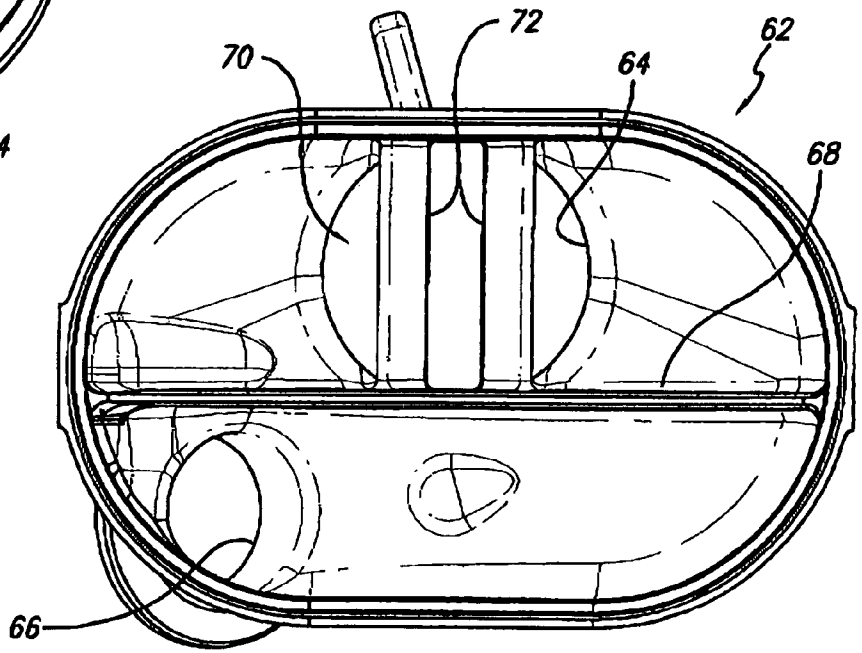
FIGS. 5A and 5B are perspective views of a two-pass heat exchanger manifold comprising a pair of integral flow directors of this invention.
Figure 5A:
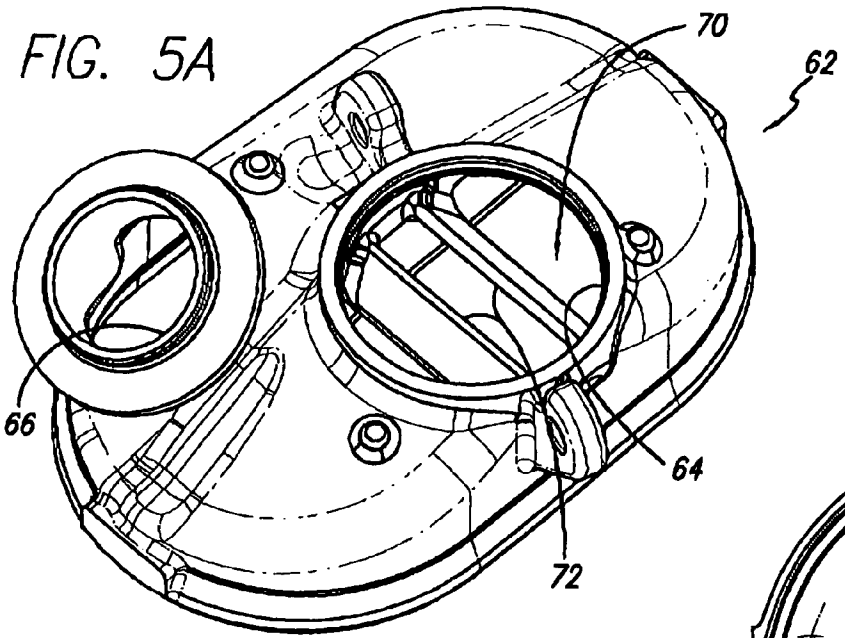

FIGS. 5A and 5B illustrate a manifold member 62 that is configured for use with a multi-pass heat exchanger. The manifold member 62 includes a fluid or gas inlet 64, a fluid or gas outlet 66, and is configured for attachment with a remaining core portion (not shown) of the heat exchanger. As shown best in FIG. 5B, the inlet and outlet portions of the manifold are separated from one another by a dividing plate 68 that is disposed within the manifold and that projects outwardly a distance therefrom.

The manifold member includes a flow director 70 of this invention disposed therein within the fluid or gas inlet portion, and downstream of the fluid or gas inlet 64. The integral flow director 70 is provided in the form of a pair of deflector members 72 that extend across the inlet 64, and that are interposed between the dividing plate 68 and an opposed wall surface of the manifold. The deflector members are shaped having a rectangular configuration and are positioned to divert the flow of fluid or gas entering the manifold in a desired manner, and can be formed as part of the manifold itself, e.g., by molding, or as separate parts from metal or the like that are attached within the manifold by conventional methods, e.g., by welding or the like.

In this particular example, the integral deflector plates are positioned having an angular orientation within the manifold calculated to deflect the entering gas or fluid in an outwardly directed manner, i.e., outwardly away from a center portion of the inlet opening. Configured in this manner, the pair of deflector plates operate to direct the concentration of entering fluid or gas to portions of the core other than that directly downstream and inline with the inlet opening 64. If desired, the flow deflector plates can be positioned in the outlet portion of the manifold.

Although a particular example of an integral flow director has been described above and illustrated in FIGS. 5A and 5B, it is to be understood that other variations of flow directors of this invention can be interchangeably used with the particular type of manifold. For example, the integral directors described above and illustrated in FIG. 4 can also be used with the manifold illustrated in FIGS. 5A and 5B, and the flow director illustrated in FIGS. 5A and 5B can also be used with the heat exchanger illustrated in FIG. 4.

Figure 6:
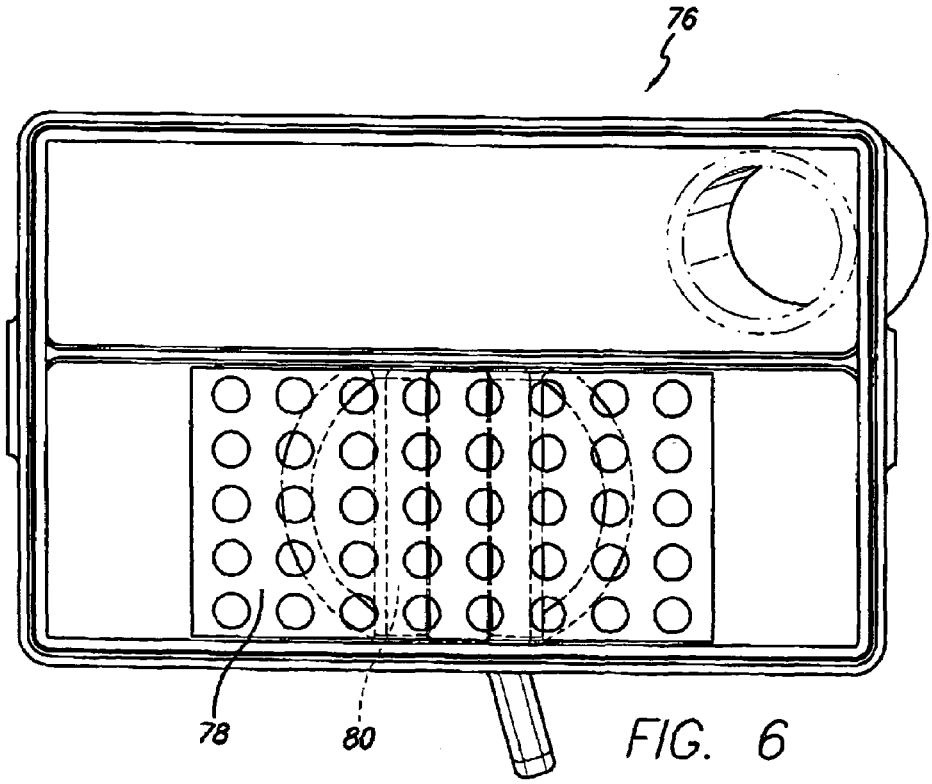
FIG. 6 is a top plan view of a two pass heat exchanger manifold comprising a perforated integral flow director of this invention.

FIG. 6 illustrates an example of this concept, wherein manifold 76 configured for use with a multi-pass heat exchanger (not shown) comprises an integral flow director of this invention that is provided in the form of a perforated member or plate 78. The perforated plate 78 is mounted within an inlet portion of the manifold, downstream of a fluid or gas inlet opening 80. The perforated member 78 can be configured to extend across the entire entry portion of the manifold or only a partial portion of the manifold, depending on the particular flow characteristics desired. The perforated member acts as a diffuser to uniformly dispense fluid or gas entering the manifold towards the core.

Figure 7:
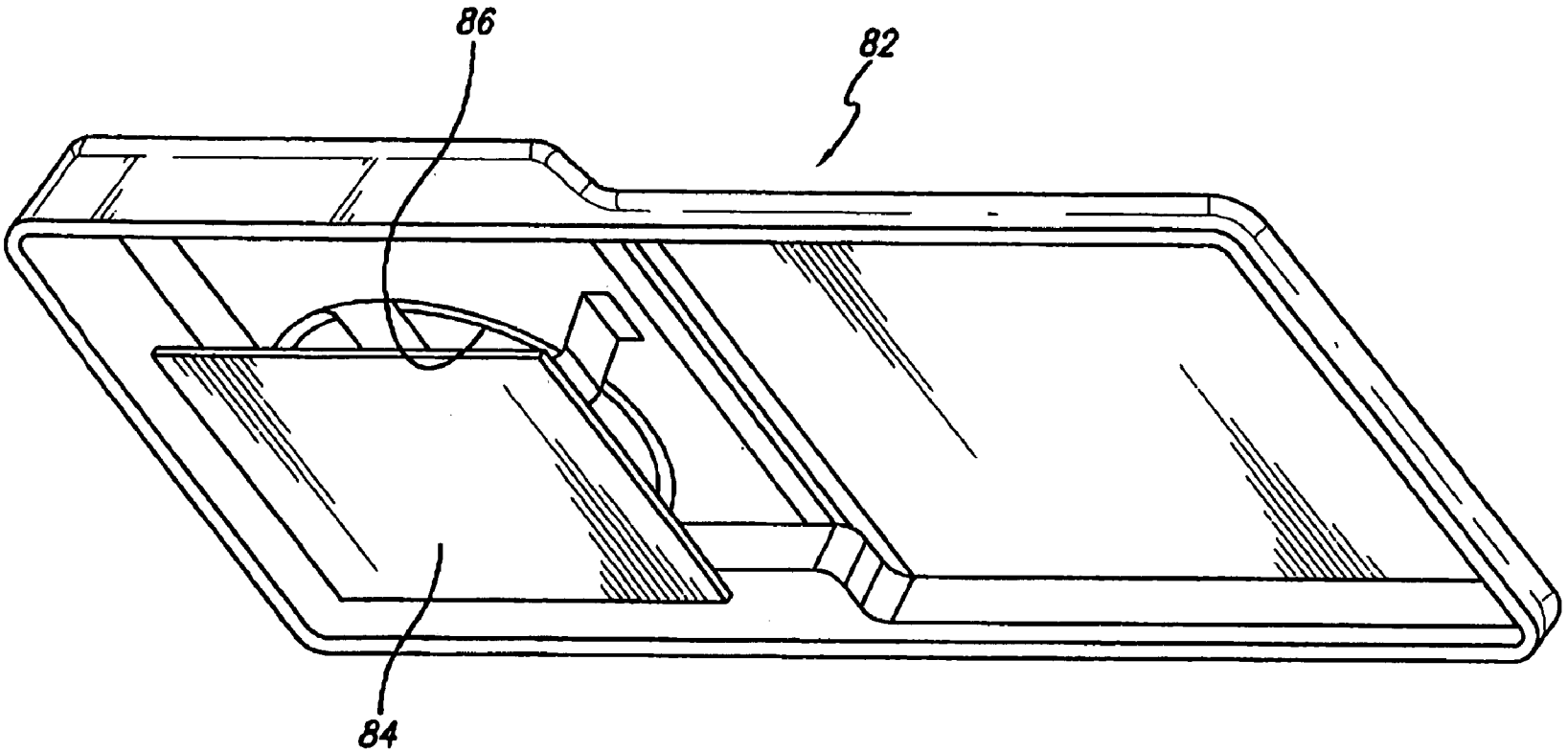
FIG. 7 is a perspective view of a heat exchanger manifold comprising a diversion plate integral flow director of this invention.

FIG. 7 illustrates a further flow director embodiment of this invention as used in conjunction with a heat exchanger manifold 82. In this embodiment, the flow director is provided in the form of a nonperforated plate or baffle 84 that is mounted within the manifold a distance downstream from the manifold inlet opening 86. Alternatively, if desired, the baffle plate can be mounted adjacent the manifold outlet opening. In this embodiment, the baffle plate operates to divert the flow path of fluid or gas entering the manifold around the plate for purposes of achieving a desired flow characteristic within the heat exchanger. Like the above described flow director embodiments, the baffle plate can be formed as part of the manifold itself, e.g., by molding, or can be made as a separate part made from a suitable structural materials that is attached within the manifold by conventional methods, such as welding.

Flow directors of this invention operate to enable the heat exchanger designer to achieve a desired fluid or gas flow direction or flow characteristic within a heat exchanger that is calculated to address unwanted flow related thermal effects therein. Such flow directors operate to correct for uneven flow conditions in the manifolds, and can create localized areas of higher heat transfer, which can minimize temperature gradients and reduce localized stress concentrations within the heat exchanger, thereby increasing heat exchanger service life.

What is claimed is:

1. A heat exchanger comprising:

a core member including:

a plurality of hot-side fluid or gas transport passages for accommodating passage of a first fluid or gas therein;

a plurality of cold-side fluid or gas transport passages for accommodating passage of a second fluid or gas therein that is provided at a temperature less than that of the first fluid or gas, the hot-side and cold-side fluid or gas transport passages being in contact with one another to permit conductive heat transfer;

a hot-side manifold and a cold-side manifold to direct and receive the first and second fluids or gases into and from the respective hot-side and cold-side fluid or gas transport passages wherein the hot-side manifold comprises a dividing wall to divide the hot-side manifold into two unequal fluid or gas portions, wherein the smaller of the unequal fluid or gas portions receives the first fluid or gas from the plurality of hot-side fluid or gas transport passages and wherein the larger of the unequal fluid or gas portions directs the first fluid into the plurality of hot-side fluid or gas transport passages and wherein the cold-side manifold comprises a dividing wall to divide the cold-side manifold into two fluid or gas portions; and a flow director integral to the hot-side manifold to change the flow direction of the first fluid or gas passing through the larger of the unequal fluid or gas portions.

2. The heat exchanger of claim 1 wherein the hot-side manifold comprises a length and a width and wherein the flow director comprises at least two members to direct the fluid or gas substantially lengthwise in the larger of the unequal fluid or gas portions of the hot-side manifold.

3. The heat exchanger of claim 2 wherein the at least two members comprise bars that act to reduce localized stress concentrations of the hot-side manifold proximate to an inlet.

4. The heat exchanger of claim 1 wherein the flow director is integral to the hot-side manifold via welding.

5. The heat exchanger of claim 1 wherein the hot-side manifold comprises an inlet to receive the first fluid or gas into the heat exchanger and an outlet that allows the first fluid or gas to exit the heat exchanger.

6. The heat exchanger of claim 1 wherein the flow director comprises one or more members that extend from the dividing wall to an opposing wall of the hot-side manifold.

7. A manifold for a heat exchanger comprising:

a dividing wall to divide the manifold into an inlet fluid or gas portion and a smaller, outlet fluid or gas portion;

an inlet associated with the inlet fluid or gas portion having a centerline and a cross-sectional flow area substantially orthogonal to the centerline;

an outlet associated with the smaller, outlet fluid or gas portion; and a flow director integral to the manifold that comprises at least two members disposed at non-orthogonal angles to the centerline of the inlet and wherein one or more of the members of the flow director extend from the dividing wall to an opposing wall of the manifold.

8. The manifold of claim 7 wherein the at least two members comprise bars that act to reduce localized stress concentrations of the manifold proximate to the inlet.

9. The manifold of claim 7 wherein the inlet comprises an inlet for gas and the outlet comprises an outlet for the gas.

10. The manifold of claim 9 wherein the gas enters the inlet a high temperature and wherein the gas exits the outlet at a lower temperature.

11. The manifold of claim 9 wherein the gas enters the inlet at a low density and wherein the gas exits the outlet at a higher density.

12. The manifold of claim 7 wherein the outlet comprises a cross-sectional flow area and wherein the cross-sectional flow area of the inlet exceeds the cross-sectional flow area of the outlet.

13. A heat exchanger comprising:

a core member including:

a plurality of hot-side fluid or gas transport passages for accommodating passage of a first fluid or gas therein;

a plurality of cold-side fluid or gas transport passages for accommodating passage of a second fluid or gas therein that is provided at a temperature less than that of the first fluid or gas, the hot-side and cold-side fluid or gas transport passages being in contact with one another to permit conductive heat transfer;

a hot-side manifold and a cold-side manifold to direct and receive the first and second fluids or gases into and from the respective hot-side and cold-side fluid or gas transport passages wherein the hot-side manifold comprises a dividing wall to divide the hot-side manifold into two unequal fluid or gas portions, wherein the smaller of the unequal fluid or gas portions receives the first fluid or gas from the plurality of hot-side fluid or gas transport passages and wherein the larger of the unequal fluid or gas portions directs the first fluid into the plurality of hot-side fluid or gas transport passages; and a flow director integral to the hot-side manifold to change the flow direction of the first fluid or gas passing through the larger of the unequal fluid or gas portions wherein the flow director comprises one or more members that extend from the dividing wall to an opposing wall of the hot-side manifold.

14. The heat exchanger of claim 13 wherein the hot-side manifold comprises a length and a width and wherein the flow director comprises at least two members to direct the fluid or gas substantially lengthwise in the larger of the unequal fluid or gas portions of the hot-side manifold.

15. The heat exchanger of claim 14 wherein the at least two members comprise bars that act to reduce localized stress concentrations of the hot-side manifold proximate to an inlet.

16. The heat exchanger of claim 13 wherein the flow director is integral to the hot-side manifold via welding.

17. The heat exchanger of claim 13 wherein the hot-side manifold comprises an inlet to receive the first fluid or gas into the heat exchanger and an outlet that allows the first fluid or gas to exit the heat exchanger.

18. The heat exchanger of claim 13 wherein the cold-side manifold comprises a dividing wall to divide the cold-side manifold into two fluid or gas portions.

* * * * *